US009110490B2

(12) United States Patent
O'Neill et al.

(10) Patent No.: US 9,110,490 B2
(45) Date of Patent: Aug. 18, 2015

(54) FLOOR MOUNT ETC PEDAL WITH INTEGRATED KICKDOWN AND TACTILE ALERT MECHANISMS

(75) Inventors: Dan O'Neill, Chatham (CA); Shaun Fuller, Ridegtown (CA)

(73) Assignee: KSR IP Holdings LLC., Wilmington, DE (US)

( * ) Notice: Subject to any disclaimer, the term of this patent is extended or adjusted under 35 U.S.C. 154(b) by 0 days.

(21) Appl. No.: 13/597,694

(22) Filed: Aug. 29, 2012

(65) Prior Publication Data

US 2013/0047775 A1 Feb. 28, 2013

Related U.S. Application Data

(60) Provisional application No. 61/529,621, filed on Aug. 31, 2011, provisional application No. 61/535,670, filed on Sep. 16, 2011.

(51) Int. Cl.

| | |
|---|---|
| ***G05G 1/30*** | (2008.04) |
| ***G05G 5/03*** | (2008.04) |
| *G05G 1/44* | (2008.04) |

(52) U.S. Cl.

CPC .. *G05G 5/03* (2013.01); *G05G 1/44* (2013.01); *Y10T 74/20528* (2015.01)

(58) Field of Classification Search

USPC ..... 74/512, 513, 560

See application file for complete search history.

(56) References Cited

U.S. PATENT DOCUMENTS

| | | | | |
|---|---|---|---|---|
| 3,500,702 | A * | 3/1970 | Nautsch et al. | 74/560 |
| 5,497,677 | A * | 3/1996 | Baumann et al. | 74/513 |
| 5,568,797 | A | 10/1996 | Landerretche | |
| 6,289,762 | B1 | 9/2001 | Silva | |
| 6,318,208 | B1 | 11/2001 | Thongs, Jr. et al. | |
| 6,981,486 | B2 | 1/2006 | Yone et al. | |
| 7,000,722 | B2 | 2/2006 | Artis et al. | |
| 7,417,532 | B2 | 8/2008 | Grill et al. | |
| 7,520,358 | B2 | 4/2009 | Ehmanns et al. | |
| 7,570,156 | B2 | 8/2009 | Cicilloni et al. | |
| 7,631,574 | B2 * | 12/2009 | Leone | 74/513 |
| 7,715,969 | B2 | 5/2010 | Yamamura | |
| 7,717,012 | B2 | 5/2010 | Kim et al. | |
| 7,725,228 | B2 | 5/2010 | Kobayashi et al. | |
| 7,770,491 | B2 | 8/2010 | Ritter et al. | |
| 7,946,192 | B2 | 5/2011 | Kim et al. | |
| 8,000,874 | B2 | 8/2011 | Tange et al. | |
| 2003/0130091 | A1 | 7/2003 | Wafzig | |
| 2004/0046652 | A1 * | 3/2004 | Yokoyama et al. | 340/454 |

(Continued)

FOREIGN PATENT DOCUMENTS

| | | |
|---|---|---|
| DE | 25 55 429 A1 | 6/1977 |
| DE | 198 10 691 A1 | 9/1999 |

(Continued)

*Primary Examiner* — Vicky Johnson

(74) *Attorney, Agent, or Firm* — Gifford, Krass, Sprinkle, Anderson & Citkowski, P.C.

(57) ABSTRACT

A pedal assembly for simulating the feel of a standard pedal assembly in a vehicle. The pedal assembly includes a pedal pivotally mounted to a housing. A lever arm is further provided connecting the pedal to the housing. A kickdown subassembly is mounted within the housing. The kickdown subassembly includes a bead and an abutment portion. Depression of the pedal assembly results in movement of the bead towards the abutment portion and provides for kickdown when the bead contacts the abutment portion and then subsequently moves past the abutment portion.

8 Claims, 5 Drawing Sheets

(56) References Cited

U.S. PATENT DOCUMENTS

| | | | | |
|---|---|---|---|---|
| 2007/0193401 | A1 | 8/2007 | Campbell | |
| 2007/0213905 | A1 | 9/2007 | Funk et al. | |
| 2007/0289402 | A1 * | 12/2007 | La et al. | 74/513 |
| 2008/0314192 | A1 * | 12/2008 | Willemsen et al. | 74/512 |
| 2010/0037726 | A1 | 2/2010 | Beck | |
| 2011/0056326 | A1 | 3/2011 | Kaijala | |
| 2011/0187521 | A1 | 8/2011 | Beruscha et al. | |

FOREIGN PATENT DOCUMENTS

| | | | |
|---|---|---|---|
| DE | 102 38 483 | A1 | 3/2004 |
| DE | 102 51 035 | A1 | 5/2004 |
| DE | 10 2006 032 576 | A1 | 11/2007 |
| DE | 10 2009 032 664 | A1 | 1/2011 |
| EP | 1 375 233 | A1 | 1/2004 |
| EP | 1 695 859 | A1 | 8/2006 |
| EP | 2 243 655 | A1 | 10/2010 |
| FR | 2 846 759 | A1 | 5/2004 |
| FR | 2 879 525 | A1 | 6/2006 |
| FR | 2 910 104 | A1 | 6/2008 |
| JP | 5-231194 | A | 9/1993 |
| JP | 10-166690 | A | 6/1998 |
| KR | 100724700 61 | | 5/2007 |
| WO | 0024602 | A2 | 5/2000 |
| WO | 2007116293 | A1 | 10/2007 |
| WO | 2009001188 | A2 | 12/2008 |
| WO | 2011116102 | A1 | 9/2011 |

* cited by examiner

FLOOR MOUNT ETC PEDAL WITH INTEGRATED KICKDOWN AND TACTILE ALERT MECHANISMS

CROSS-REFERENCE TO RELATED APPLICATIONS

This application claims priority of U.S. Provisional Application 61/529,621 filed Aug. 31, 2011, and U.S. Provisional Application 61/535,670 filed Sep. 16, 2011, the contents of which are incorporated herein by reference.

FIELD OF THE INVENTION

This invention relates generally to pedal assemblies. More particularly, this invention relates to an ETC pedal assembly replicating the feel of a standard pedal.

BACKGROUND OF THE INVENTION

It is known to use pedal assemblies having position sensors to produce a "fly-by-wire type" pedal assembly for vehicle control such as brake and throttle operation. A significant drawback of these pedal assemblies is the removal of the physical connection of the pedal to the vehicle control. This removes the resistance or pedal feel that the driver typically is accustomed to during vehicle operation. As such, it is desirable to simulate the feel of mechanical pedal assemblies. Additionally, it is advantageous to provide a kickdown feature to provide clearly perceptible increase in the reaction force prior to the point when a downshifting signal is sent during a forceful depression of the accelerator pedal.

SUMMARY OF THE INVENTION

The present invention relates to a pedal assembly for simulating the feel of a standard pedal assembly in a vehicle. The pedal assembly includes a pedal pivotally mounted to a housing. A lever arm or connecting rod is further provided connecting the pedal to the housing. A kickdown subassembly is mounted within the housing. The kickdown subassembly includes a bead and an abutment portion. Depression of the pedal results in movement of the bead towards the abutment portion and provides for kickdown when the bead contacts the abutment portion and then subsequently moves over and past the abutment portion.

DETAILED DESCRIPTION OF THE INVENTION

The present invention is a floor mount ETC pedal assembly with a kickdown feature. The assembly includes a housing member and a pedal. The pedal is mounted to the housing member. The pedal is also connected by a connecting rod to the housing. The lever arm has a hub which is pivotally mounted within the housing. The housing also contains a hysteresis generating device and a kickdown feature.

Figure 1:
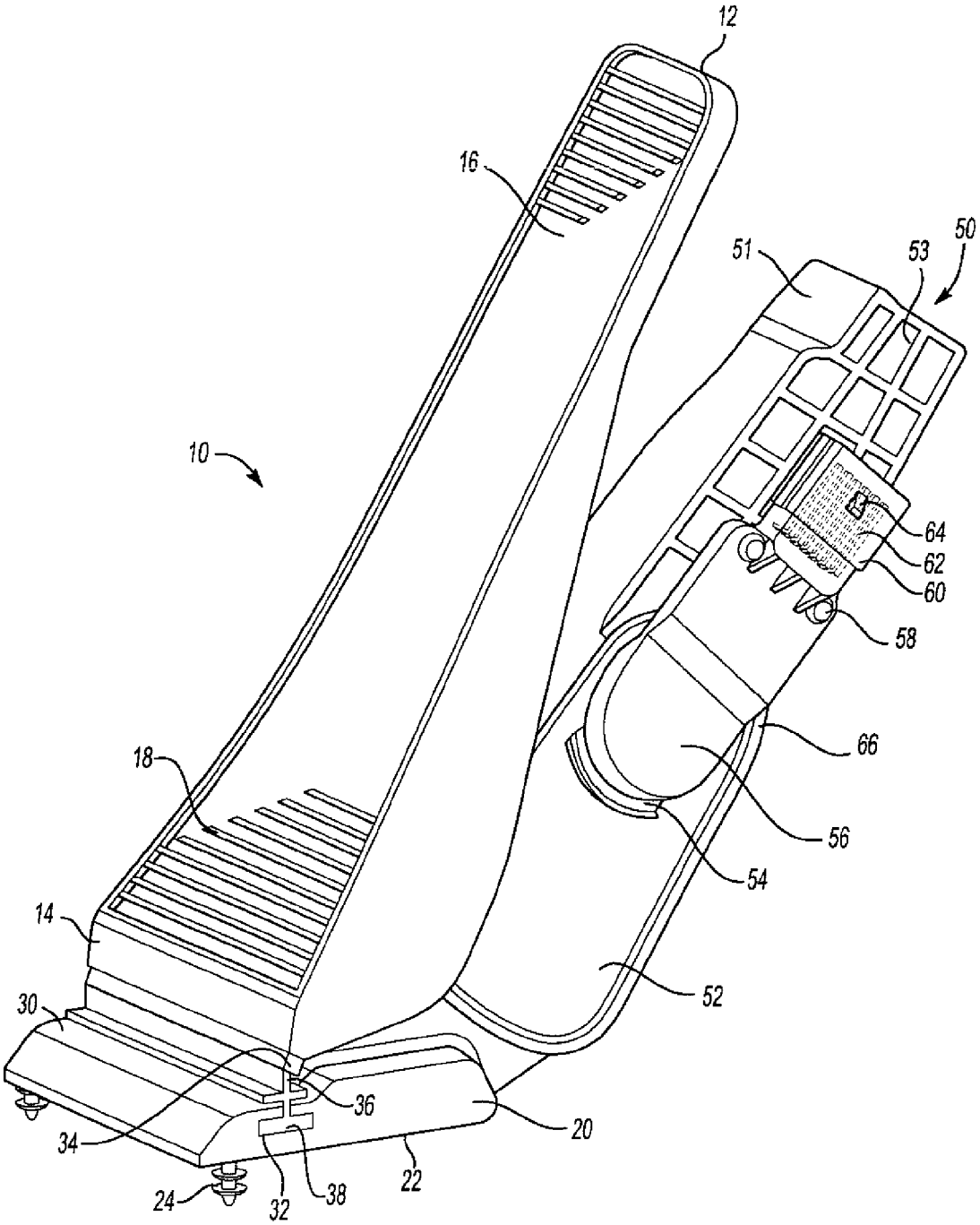
FIG. 1 illustrates a perspective view of the pedal assembly of the present invention.

FIG. 1 illustrates the pedal assembly of the present invention. The pedal assembly 10 is provided having a pedal 16 having an upper portion 12 and a lower portion 14. The pedal assembly 10 and pedal 16 further include traction portions 18 to aid in gripping the user foot to the pedal.

The pedal assembly 10 further includes a housing 50 containing a generally rectangular boxlike structure 51 angled from a lower end 20. The housing 50 is operable to hold various components of the pedal assembly. The housing 50 includes structural elements 53 an cover 52.

The pedal 16 connects to a lower portion or base 20. The base 20 includes a lower surface 22 operable to be flush with a floor of a vehicle. The lower surface 22 includes a plurality of connection members 24. The connection members 24 may be snap fit bosses or other clip means. The base 20 further includes an upper surface 30. The upper surface 30 is operable to connect to the pedal 16. The base 20 includes a structural indentation 32 corresponding to structure at the lower portion 14 of the pedal 16. In the present embodiment the structure is generally I or T shaped. The base 20 includes an aperture or structure identical to that of the lower portion 14 of the pedal 16.

The connection portions 34, 36 connecting the pedal 16 to the base 20 are a living hinge. The living hinge 34, 36 allows the pedal 16 to flex and pivot at the base 20 and the living hinge 34, 36.

The living hinge 34, 36 extends between the end portion of the base 20 and the pad portion or pedal 16. A pair of wings extend from the pad portion towards the housing to cover a connecting arm.

Figure 2:
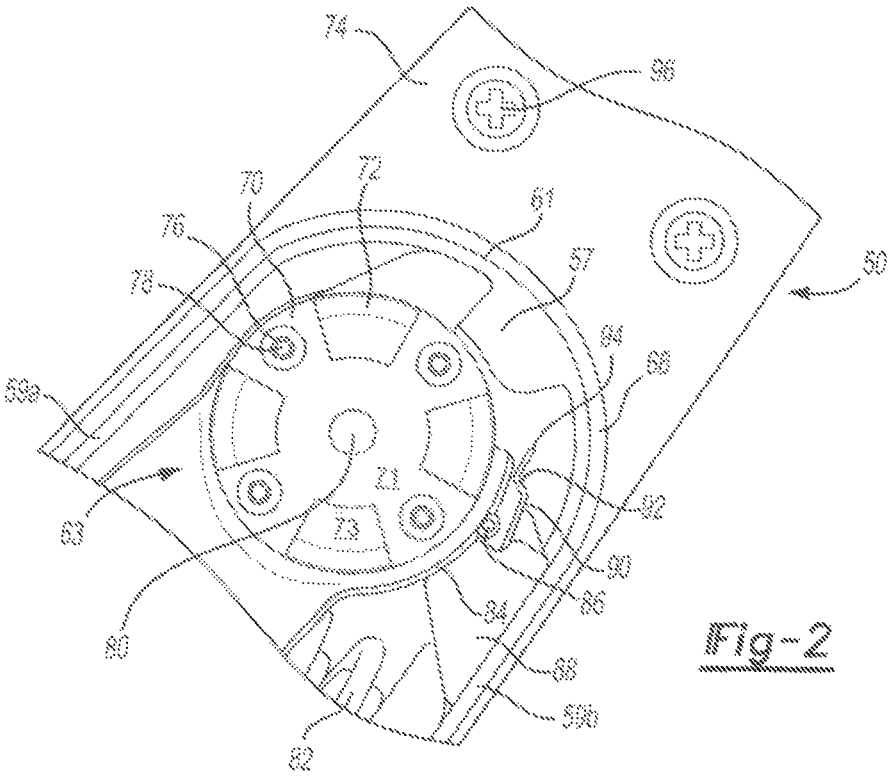
FIG. 2 illustrates a side view of the kickdown subassembly in a rest position.
Figure 3:
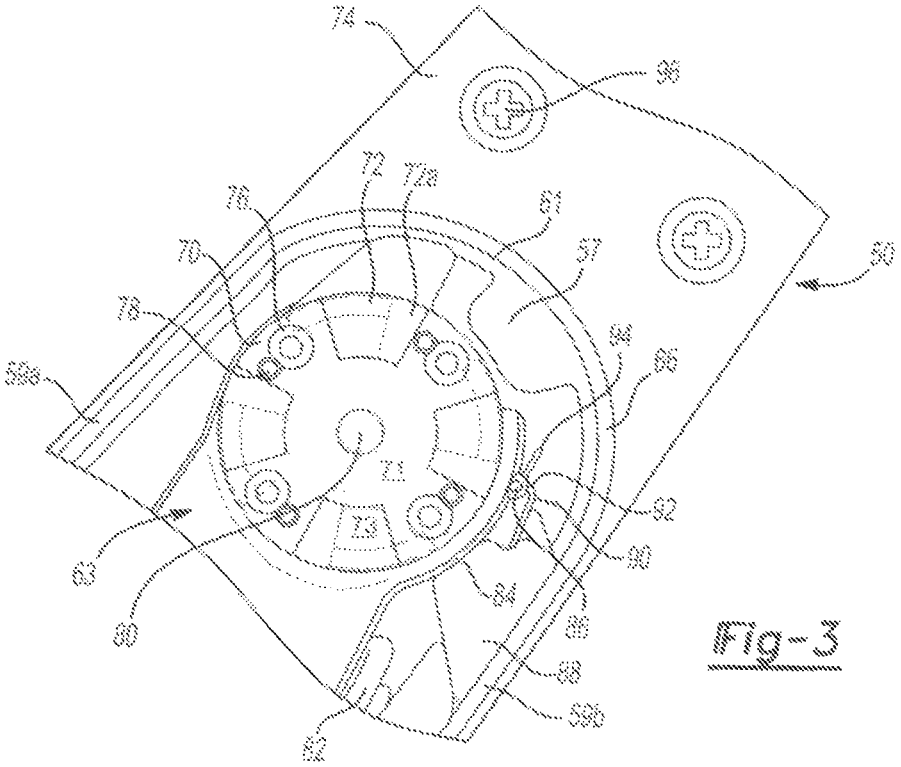
FIG. 3 illustrates the kickdown subassembly in a working position.

As shown in FIGS. 2 and 3, the housing 50 has an inner cavity 57 extending between a pair of side walls 59*a*, 59*b*. The housing 50 further includes an upper radiused wall 61. A support boss with an angled surface extends on the front side wall.

A hub portion 63 or kickdown feature is illustrated in FIGS. 2 and 3. The hub portion is mounted to a pin 80. A partially tubular cavity is formed to receive a ball of a connecting rod at the other end (to be discussed below). The hub 63 further includes at least one planar disk 70, 72 having disk surfaces 71, 73. The disks 70, 72 have a plurality of apertures 76, 78 which are aligned with various planar disks 70, 72 when the disks are at rest as shown in FIG. 2. When the disks 70, 72 rotate about one another, as shown in FIG. 3, the various apertures 72*a*, 74, 76, 78 become misaligned.

The hub 63 further includes a circumferential friction disk surfaces 71, 73. The hub 63 further includes a blocking plate. The blocking plate function is part of a noncontacting position sensor. A ridge or bead 86 extends in an axial direction along the friction surfaces. The bead 86 is biased against a slide 88 when the pedal is at rest, as shown in FIG. 2. Rotation of the hub 63 moves the bead away from the slide 88 to an abutment portion 92. The abutment portion 92 includes a lower portion 90 and an upper portion 94. An abutment surface and abutment portion 92 is operable to hinder movement of the bead 86 to prevent, or delay, the hub from further rotation. This friction surface provides for hysteresis. As the bead 86 slides along the abutment portion 92, friction is created and/or a signal is sent to provide the hysteresis. A signal may be send to a control system to activate the hysteresis. Further, a signal by be sent to the various motors to provide vibratory responses.

A finger extends outwardly from the hub and is positioned to engage the abutment portion of the housing. The abutment portion 92, also known as a spring steel element, extends outwardly from a slide 88 along the friction surface. Depression of the pedal 16 results in rotation of the rotor or hub 63 to move the bead 86 towards the abutment portion 92 or the spring steel element. When the pedal 16 is depressed sufficiently, the bead 86 contacts the spring steel element or abutment portion 92 and moves the abutment portion 92 out of the way to provide a kickdown. The kickdown feature allows the user to quickly accelerate as the pedal movement is then not stifled.

Figure 4:
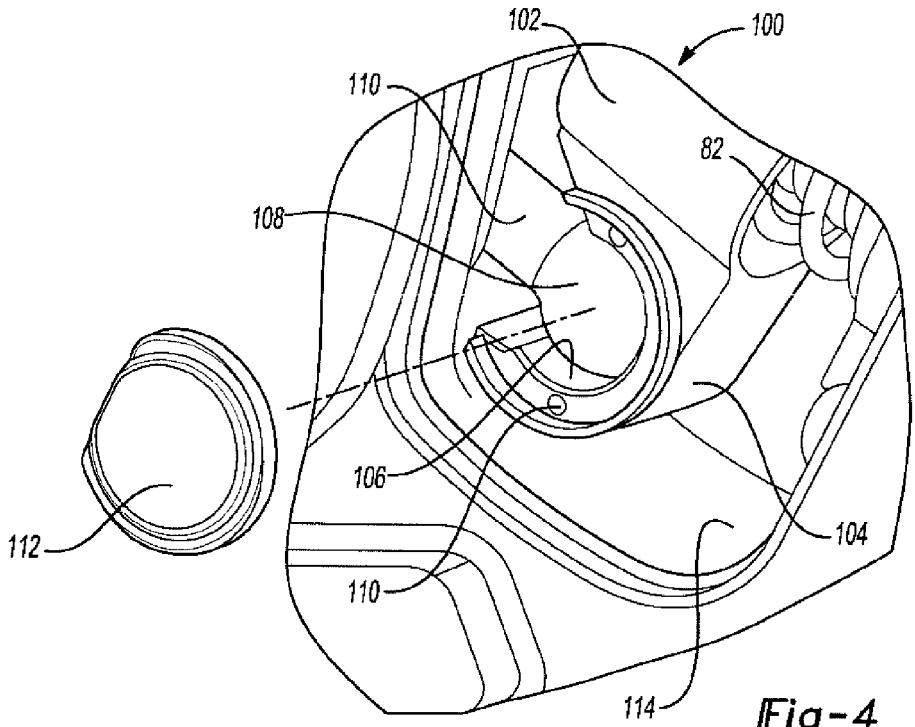
FIG. 4 illustrates an exploded perspective view of the connection of the pedal to the housing.

As shown in FIG. 4, a cup 106 is formed between the lower hub and the tubular cavity 102 to receive a coil spring 82. The coil spring 82 extends between the cup 106 and a trapezoidal shaped end cap. The end cap has two angled side surfaces. The spring 82 biases the lever away from the end cap so that the finger engages the stop and bead 86 engages the slide 88. The connecting rod 110 includes a ball portion 108. The cup 106 is operable to receive the ball 108. Various connection members 110 secure the apparatus together. A cap 112 is used to cover the ball joint created by the ball 108 and the cup 106.

Further, a cavity 114 is provided within the housing. The connection portion 104 connects the ball 108 and connecting rod 110 to the spring 82. The connecting rod 110 provides further support and connects the pedal 16 to the housing 50. The connecting rod 110 may pivot and rotate within the cavity 106. The connecting rod 110 puts less stress on the pedal functionality should the pedal experience a side load condition.

Figure 5:
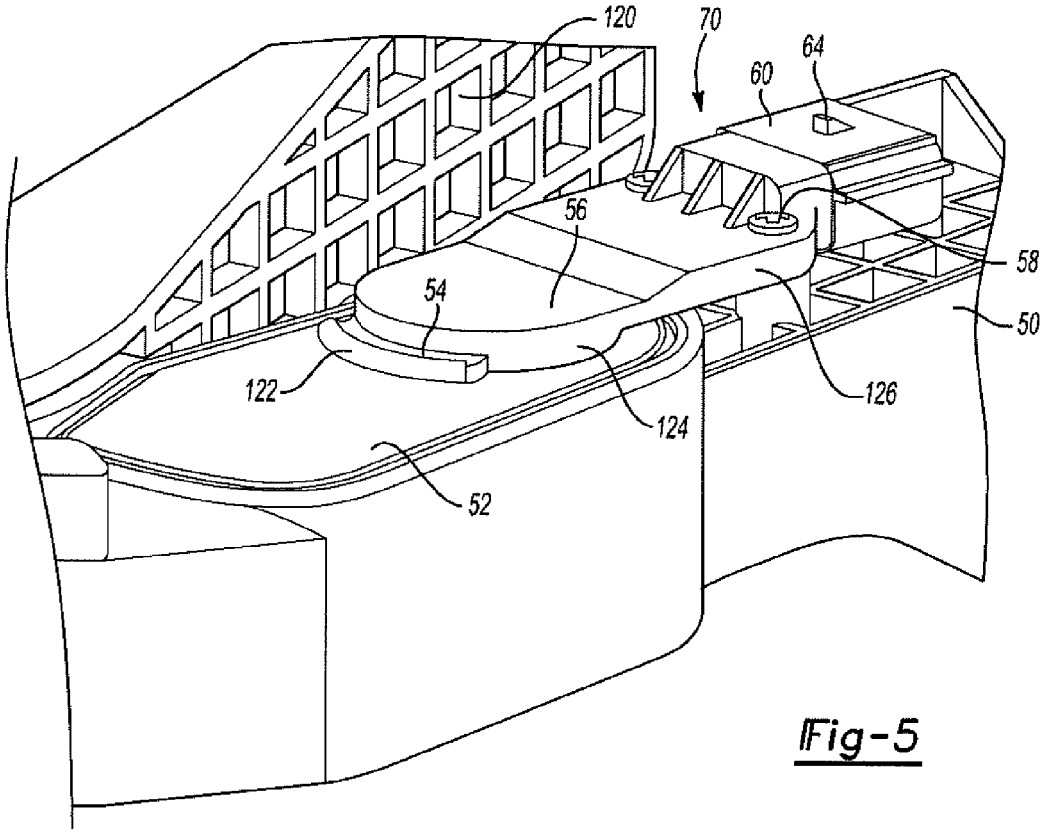
FIG. 5 illustrates a perspective view of the pedal assembly including the sensor.

As shown in FIG. 5, a cover piece 56 is snapped into position to cover the cavity in the housing 50. The cover 56 has a circular opening to expose the blocking plate. An encapsulated electronic unit 62 is attached using a heat stake rollover operation shown at the reference numerals 64, 122. Various structural elements 58, 64 are also used to connect the cover piece 56 to the housing 50. The heat stake rollover application is shown at the connection portion as shown in reference numerals 54, 122. A connector portion 60 of the cover 56 connects to a wiring harness to deliver the signal produced by the position sensor to the throttle. Any type of noncontacting position sensor may be used; however, a suitable sensor is maintained by the assignee of the present invention. The sensor may be connected to a control unit operable to send signals to the appropriate area. The sensor may send a signal to a control unit, and the control unit will send a signal to a vibratory motor to notify the driver of a particular vehicle condition.

Figure 6:
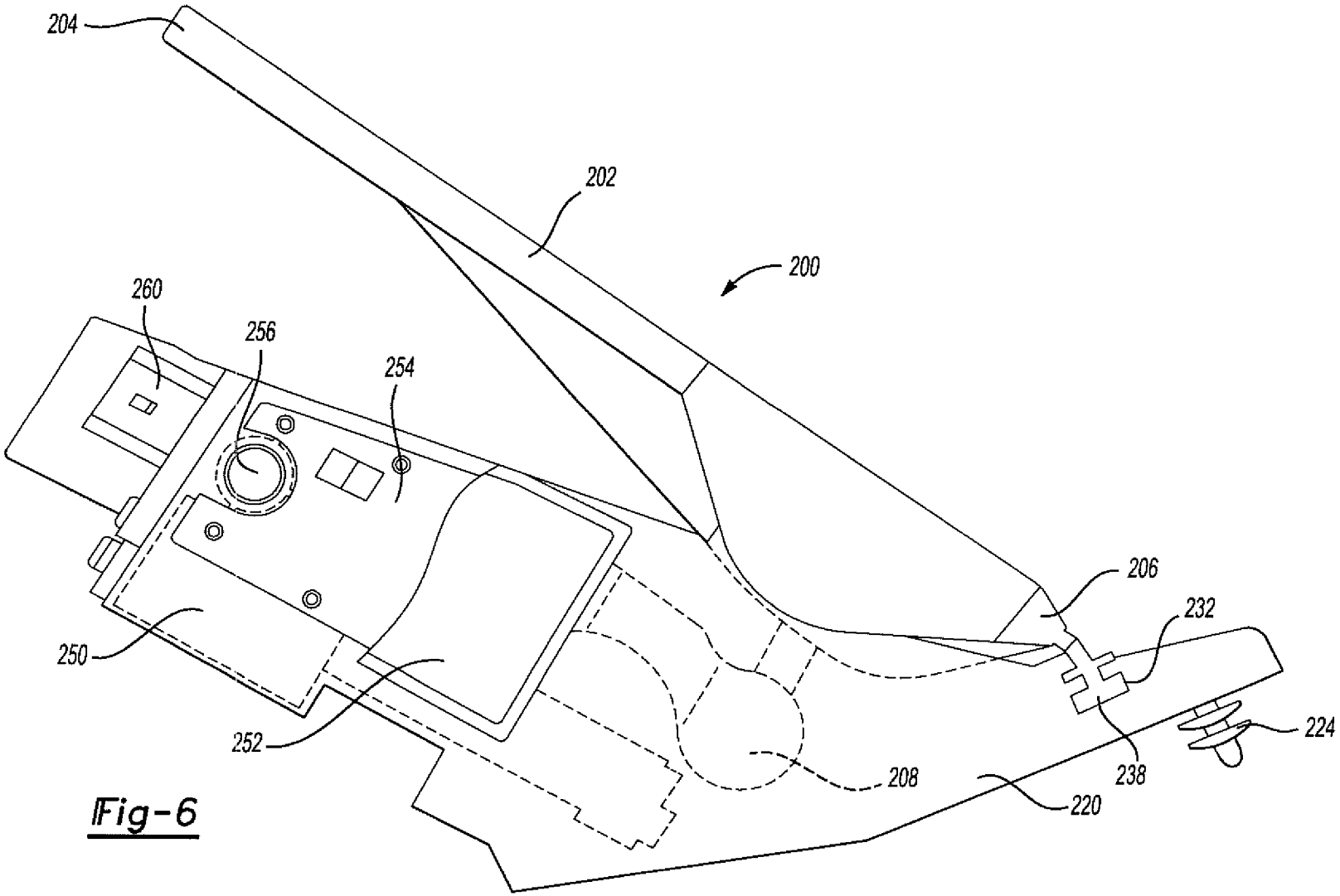
FIG. 6 illustrates a side view of the pedal assembly.
Figure 7:
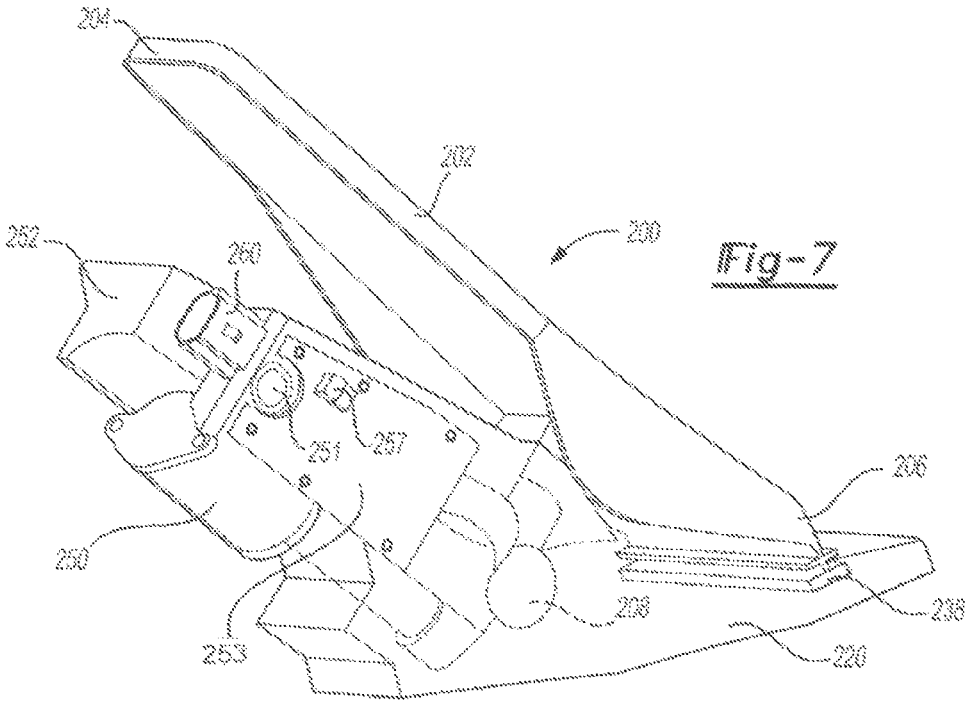
FIG. 7 illustrates a perspective side-rear view of the pedal assembly.
Figure 8:
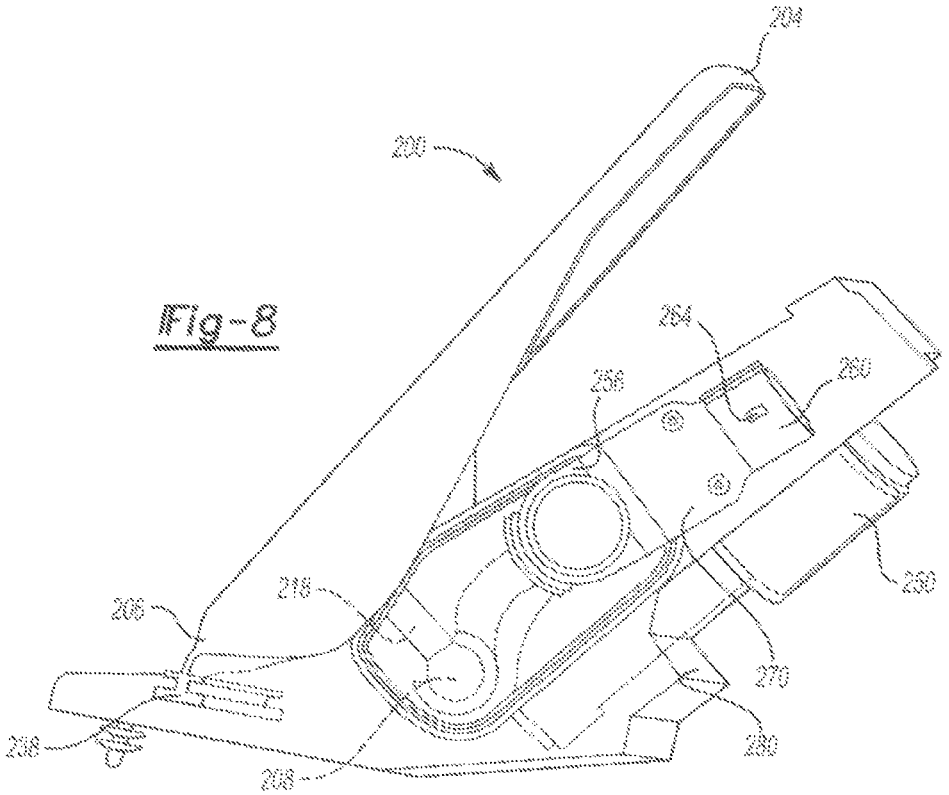
FIG. 8 illustrates a side view of the pedal assembly having sensors and various vibration-creating motors.

FIGS. 6-8 illustrate a second embodiment of the pedal assembly including the tactile feedback mechanisms. These tactile feedback mechanisms are generally discussed above and may also include the use of a control unit operable to receive signals from sensors and operable to instruct motors or other units to perform. The tactile feedback mechanisms may include both a vibratory mechanism and a haptic mechanism. The pedal assembly 200 includes a pedal 202 having an upper portion and a lower portion 206. The same structural elements and living hinge 238 are applied to the secondary embodiment as were structurally applied in the previous embodiment discussed above. The pedal 202 connects to the base 220 of the assembly. A housing 252 includes an electronic unit 260. The housing 252 includes various vibratory and haptic mechanisms 250. When a sensor is triggered, the vibratory and haptic mechanisms 250 create sensory alerts to the user. When the sensor is triggered, a control unit also located within the sensor may send a signal to the vibratory and haptic mechanisms 250 to activate the mechanisms and provide a warning or other alert to the drive by vibrating the pedal.

A control unit 251 receives signals from the appropriate external sensors and sends a signal to activate either the vibratory motor or the haptic motor or both. Different tactile feedbacks may be provided for different tactile alerts for different conditions. Thus, the mechanism 250 can be activated by the control unit 251 when it is determined by a driver alertness system that the driver is drowsy and a separate signal can be generated to activate the haptic mechanisms indicating, for instance, a potential collision threat.

A mechanism 250 is mounted to extend transversely along the housing 252. The mechanism 250 moves a weight to cause vibration. The vibration is carried through the housing and connecting rod to the pedal 202 thus providing a vibratory sensation which is tactilely sensed by the driver's foot.

The feedback mechanisms provide tactile feedback to the driver's foot through the pedal to alert the driver to desired conditions. These conditions may be, for example, excessive speed, driver alertness, and collision avoidance. The system includes a control unit mounted to the housing 252 which receives signals from external sources such as radar sensors, a driver awareness system, or a speedometer and determines by reference to predetermined rules when to provide signals to the feedback mechanisms.

These FIGS. 6-8 illustrate the housing of the first embodiment described in FIGS. 1-5 and have been altered to accommodate a vibratory mechanism, a haptic mechanism, and a control unit. As shown in FIG. 7, the control unit 251 includes a cover 253 which extends over the sensor and over the mechanism 250.

The mechanism 250 is mounted to the forward side of the housing 252 opposite the pedal 202. The mechanism 250, which may be a haptic motos, is a DC motor and is operable to axially move a rod supporting a boss member on the free end of the rod. The boss member has an angled surface and replaces the support boss in the first embodiment. Activation of the haptic motor results in movement of the rod in an axial direction towards the motor which draws the angled surface of the support boss member against the correspondingly angled surface of the end cap holding the spring to compress the spring. Compression of the spring results in a greater return force delivered by the arm and connecting rod to the pedal. The increased return force is thus sensed tactilely by the driver's foot.

The ball joint 108, 208 is inserted from one end of the cylindrical opening and a cap is snapped in place over the opening. The ball joint 108, 208 connection puts less stress on the pedal functionality should the pedal experience a side load condition.

The noncontacting position sensor frequently used involves rotation of the hub as shown in FIGS. 2 and 3 creating eddy currents in the coils which are measured to determine rotation of the hub.

Thus is disclosed a compact pedal assembly having hysteresis and a kickdown feature as well as tactile alert mechanisms.

The invention is not restricted to the illustrative examples and embodiments described above. The embodiments are not intended as limitations on the scope of the invention. Methods, apparatus, compositions, and the like described herein are exemplary and not intended as limitations on the scope of the invention. Changes therein and other uses will occur to those skilled in the art. The scope of the invention is defined by the scope of the appended claims.

The invention claimed is:

1. A pedal assembly for simulating the feel of a standard pedal assembly in a vehicle, the pedal assembly for use in a vehicle, the pedal assembly comprising:

a pedal pivotally mounted to a housing, a position sensor mounted to the housing;

a hub mounted in the housing, the hub having a bead and an abutment portion, the bead is directly connected to the hub, the abutment portion being elongated and having an abutment surface, the bead rotated when the hub is rotated, the bead slideable along the abutment surface from a first position to a second position to a third position upon depression of the pedal, the bead extending in a radial direction with respect to the rotation of the hub, the abutment portion extending away from a slide, the slide connected to the housing, the slide spaced apart from the bead in the second position and the third position;

the first position defined where the bead is arranged to bias against the slide;

the second position defined when the bead is in contact with the abutment portion to provide hysteresis to the driver;

the third position defined when the bead sliding on the abutment surface over, past and beyond the abutment portion providing for kickdown, the third position further defined when the bead has rotated past the abutment portion and the abutment surface of the abutment member, the third position further defined where the bead is spaced apart from both the abutment portion and the abutment surface of the abutment member.

2. The pedal assembly of claim 1 wherein the pedal further connects to the housing by means of a rod.

3. The pedal assembly of claim 1 wherein the pedal is connected to the housing with a living hinge.

4. The pedal assembly of claim 3 wherein the pedal connects to the housing with a living hinge having a connector with at least one flange.

5. The pedal assembly of claim 4 wherein the housing includes corresponding structure to accept the connector of the living hinge.

6. The pedal assembly of claim 1 wherein the pedal assembly further includes a vibratory motor.

7. The pedal assembly of claim 1 wherein the housing includes at least one snap fit boss operable to engage and connect to the vehicle floor.

8. A pedal assembly for simulating the feel of a standard pedal assembly in a vehicle and providing notification to a vehicle user, the pedal assembly for use in a vehicle, the pedal assembly comprising:

a pedal pivotally mounted to a housing, a position sensor mounted to the housing;

a vibratory motor connected to the pedal, the vibratory motor mounted to the housing; and a hub mounted to the housing, the hub having a bead and an abutment portion, the bead is directly connected to the hub, the abutment portion being elongated and having an abutment surface the bead slideable along the abutment surface from a first position to a second position upon depression of the pedal, the hub including two disks each having a friction surface rotatable with respect to each other, the disks becoming misaligned upon rotation of the hub, the bead adapted to rotate with the disks upon rotation of the hub, the bead extending in a radial direction with respect to the friction surfaces, the abutment portion extending away from a slide, the slide connected to the housing the slide spaced apart from the bead in the second position and the third position;

the first position defined where the bead is arranged to bias against the slide;

the second position defined when the bead is in contact with the abutment portion to provide hysteresis to the driver;

the third position defined when the bead sliding on the abutment surface over, past and beyond the abutment portion providing for kickdown, the third position further defined when the bead has rotated past the abutment portion, the third position further defined where the bead is spaced apart from the abutment portion.

* * * * *